US010674794B2

(12) United States Patent
Snyder et al.

(10) Patent No.: US 10,674,794 B2
(45) Date of Patent: Jun. 9, 2020

(54) ADHESIVE ARTICLES, DEVICES AND METHODS FOR SHOE MANUFACTURING

(71) Applicant: IFS Industries Inc., Reading, PA (US)

(72) Inventors: Joel Snyder, Wyomissing, PA (US); Brad Coleman, Vancouver, WA (US); Jose Marin, Frisco, TX (US); Andrew Michael Kawaja, San Francisco, CA (US)

(73) Assignee: IFS Industries Inc., Reading, PA (US)

( * ) Notice: Subject to any disclaimer, the term of this patent is extended or adjusted under 35 U.S.C. 154(b) by 141 days.

(21) Appl. No.: 15/229,803

(22) Filed: Aug. 5, 2016

(65) Prior Publication Data

US 2017/0035153 A1 Feb. 9, 2017

Related U.S. Application Data

(60) Provisional application No. 62/201,395, filed on Aug. 5, 2015.

(51) Int. Cl.

| | |
|---|---|
| ***A43D 25/18*** | (2006.01) |
| ***B24C 1/00*** | (2006.01) |
| ***A43B 13/14*** | (2006.01) |
| ***A43B 13/32*** | (2006.01) |
| ***A43D 3/02*** | (2006.01) |
| *A43D 25/20* | (2006.01) |
| *A43D 999/00* | (2006.01) |

(52) U.S. Cl.

CPC ..... *A43D 25/183* (2013.01); *A43B 13/14* (2013.01); *A43B 13/32* (2013.01); *A43D 3/02* (2013.01); *B24C 1/003* (2013.01); *A43D 25/20* (2013.01); *A43D 999/00* (2013.01)

(58) Field of Classification Search

USPC ..... 118/211, 252, 411, 412, 419, 225; 427/258, 207.1, 208.2

See application file for complete search history.

(56) References Cited

U.S. PATENT DOCUMENTS

| | | | | |
|---|---|---|---|---|
| 2,064,932 | A * | 12/1936 | MacKenzie | A43D 25/183 118/252 |
| 2,867,189 | A * | 1/1959 | Dawson | A43D 25/183 118/409 |
| 3,278,960 | A | 10/1966 | Nardone | |
| 3,522,343 | A | 7/1970 | Chandler et al. | |
| 3,526,528 | A * | 9/1970 | Ishiwata | B05C 5/0254 118/410 |
| 4,098,632 | A | 7/1978 | Sprague, Jr. | |
| 4,537,801 | A * | 8/1985 | Takeda | B05C 5/0254 118/123 |
| 5,155,163 | A | 10/1992 | Abeywardena et al. | |
| 5,203,792 | A | 4/1993 | Kaiser | |

FOREIGN PATENT DOCUMENTS

| | | |
|---|---|---|
| DE | 3003986 | 8/1981 |
| EP | 0471504 | 2/1992 |

OTHER PUBLICATIONS

International Search Report in International Application No. PCT/US2016/045820, dated Dec. 16, 2016, 3 pages.

* cited by examiner

*Primary Examiner* — Yewebdar T Tadesse
(74) *Attorney, Agent, or Firm* — Fish & Richardson P.C.

(57) ABSTRACT

This document relates to adhesive application devices and methods for applying an adhesive on a shoe during manufacturing.

20 Claims, 8 Drawing Sheets

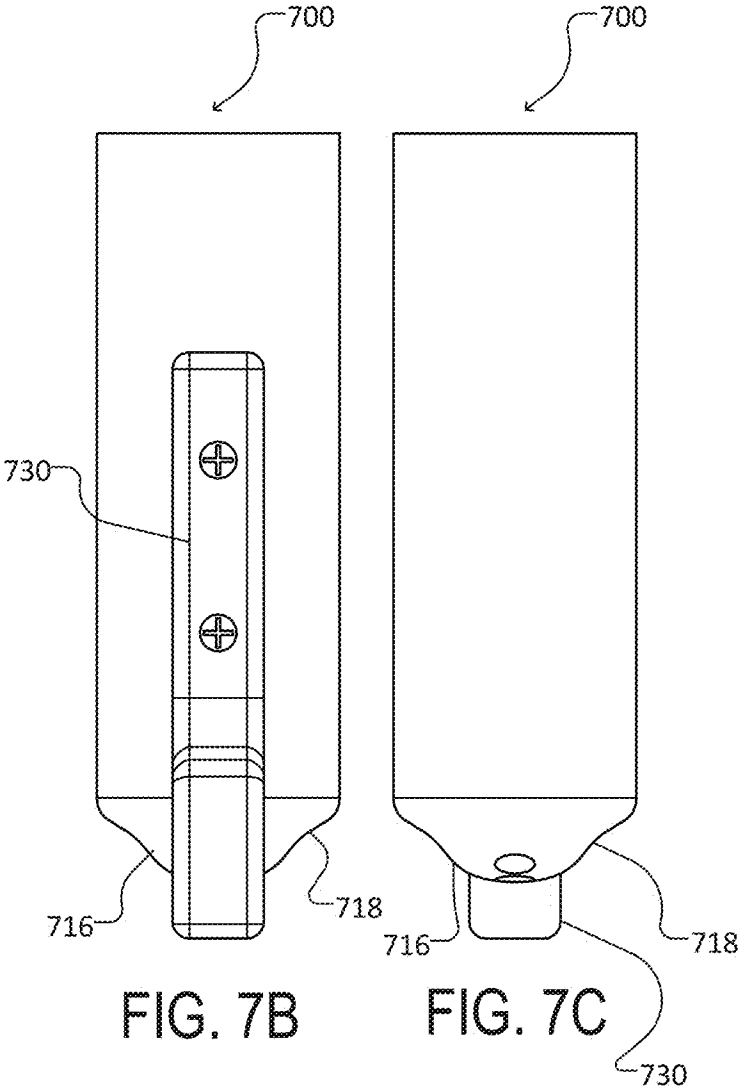
FIG. 7C
FIG. 7B
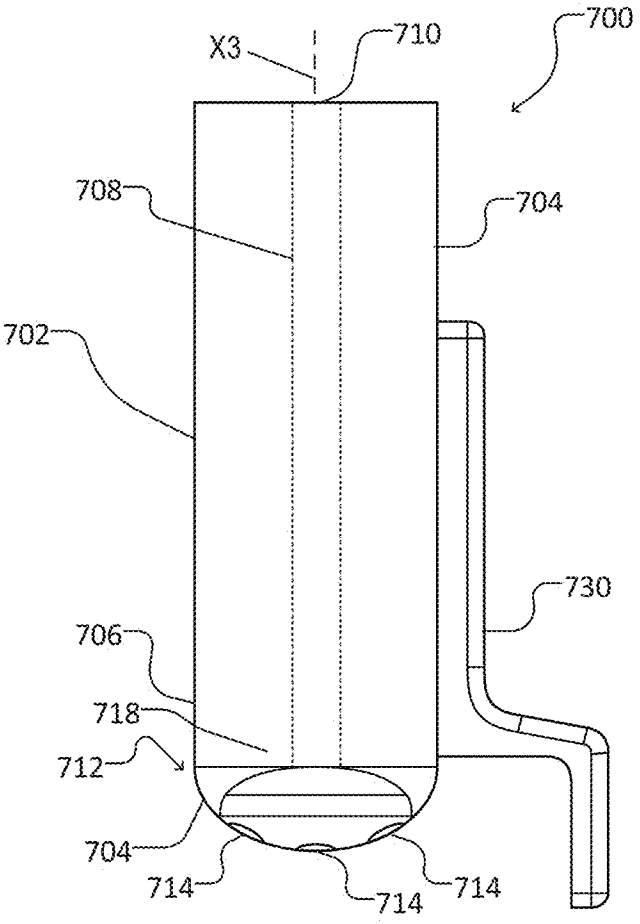
FIG. 7A

ADHESIVE ARTICLES, DEVICES AND METHODS FOR SHOE MANUFACTURING

CROSS-REFERENCE TO RELATED APPLICATIONS

This application claims the benefit of U.S. Provisional Application Ser. No. 62/201,395, filed Aug. 5, 2015. The disclosure of the prior application is considered part of (and is incorporated by reference in) the disclosure of this application.

TECHNICAL FIELD

This document relates to adhesive application devices and methods for applying an adhesive on a shoe during manufacturing.

BACKGROUND

In the manufacture of shoes, such as athletic shoes, the controlled application of a curable adhesive in a shoe article for the purpose of maintaining a mechanically stable end product is desirable. In the past, contact adhesives, hot melt adhesives and other types of adhesives have been used in the manufacture of shoes. The methods and devices used for manufacturing shoes have generally remained relatively complex and time consuming. Furthermore, adhesives used in shoe manufacturing can slow to form final mechanically stable bonds for obtaining a mechanically sound article. While previous methods, adhesives, and application devices may have formed useful bonds, the application of the adhesive often could lead to lower than desired manufacturing yield rates due to adhesive squeeze out, or soiling, of the exterior surfaces of the final shoe product. Such soiling results from the application of excessive amounts of adhesive that can be expelled from the bonding zone to the exterior surfaces of the shoe upper or sole where the flaws would be visible to a customer.

A substantial need exists for a method of shoe assembly and an apparatus for curable adhesive application that obtains highly productive shoe assembly with minimal steps but still results in high quality structural adhesive bonding in a mechanically stable shoe product.

SUMMARY

This document relates to an adhesive application device (e.g., an adhesive applicator) and methods for applying an adhesive (e.g., a curable adhesive) on a shoe during manufacturing. Various embodiments provided herein of the application devices and the methods include an adhesive formulated and blended for the permanent formation of mechanically stable articles, in particular, the attachment of a sole to a shoe upper.

In some embodiments, the methods and adhesive applicators described herein are used to apply a hot melt adhesive, or a two part curable adhesive, to a portion of a shoe, such as a sole or an upper, in a controlled application amount that results in dispensing a desired thickness of adhesive on the shoe sole. Some embodiments of the methods and applicators described herein can maintained at an effective application temperature of an adhesive that is about to be dispensed onto the shoe. In some embodiments, an applicator provided herein can receive an adhesive and apply the adhesive to a joint surface of a sole or upper in a pattern having a width, thickness and add-on amount appropriate for a mechanically stable shoe article. The applicator described herein can contain a mixing means for mixing two or more parts of an adhesive prior to applying the adhesive to a shoe. For example, in some embodiments, the applicator can include a portion that ensures either the uniform application of the hot melt adhesive or the appropriate mixing of a two part curable adhesive. In some embodiments, the applicator can contain two or more, three, four, five, six, seven, eight, nine or ten orifices that are used in conjunction with an application surface of the applicator such that the adhesive is placed on the sole or upper in a pattern for adhesion.

Some embodiments provided herein of an applicator can include a tip with a contact surface designed and configured to meter the adhesive into a desired width, depth and add-on amount when used with a particular control of flow rate and adhesive temperature. In some embodiments, the applicator tip has a contact surface configured to bias a dispensed adhesive towards a central region of the sole or upper. In some embodiments, during use, the applicator can be angled to promote adhesive, while it is still in a fluid state, generally to the central region of the application zone to reduce or eliminate the adhesive from overflowing to a periphery edge of the application zone of the sole or upper when the sole and upper are assembled to form a final shoe article. The application apparatus is mounted on a moveable device and can be controlled such that the application apparatus carefully traces the application zone on the sole or upper in a careful pattern leaving, if desired, an unadhered periphery on the sole or upper of about two millimeters or less commonly one millimeter or less. This unadhered peripheral zone further ensures that little or no adhesive will exit the application zone during shoe assembly.

Certain embodiments provided herein of the methods and application devices dispense a viscous fluid adhesive, e.g., an adhesive in a hot melt form or a hot two part form, to form an adhesive zone of adhesive along a desired application location, e.g., a peripheral region of a sole or upper. An additional feature of the invention is a method and apparatus that ensures that the joining surfaces typically a sole and an upper obtain a fluid adhesive in an adhesive pattern having a width depth and add on amount on the periphery of a soul or upper under conditions that result in superior adhesive bonding, rapid productivity and little or no adhesive soiling or wastage outside the application zone. The unique pattern of adhesive application ensures that the adhesive is used only in an application zone that can result in strong mechanically stable bonds such that the shoe and sole elements are joined together in a permanent fashion.

Some embodiments provided herein includes a shoe sole having an outer surface, an inner surface, and a lateral wall therebetween. In some embodiments, the inner surface can have a continuous application zone proximate to a periphery of the inner surface. The continuous application zone may optionally have a width ranging from about 15 to about 20 millimeters. The continuous application zone, in some embodiments, can include an adhesive in an amount of about 0.5 grams to about 5 grams per shoe along the continuous application zone.

In some embodiments, the inner surface of the shoe sole can include a peripheral zone between the application zone and the periphery of the inner surface, in which the peripheral zone is free or substantially free of an adhesive. In some embodiments, the peripheral zone is free or substantially free of the adhesive prior to the shoe sole being coupled to a shoe upper. The periphery zone, in certain embodiments, can have a continuous area adjacent to the periphery of the shoe sole that is free of the adhesive after the shoe sole has been coupled to a shoe upper. A suitable periphery zone can be sized and shaped to reduce or prevent the adhesive from squeezing out to the periphery of the shoe sole when the shoe sole is coupled to a shoe upper. In some embodiments, the periphery zone can have a width of about 15 to about 20 millimeters.

Certain embodiments provided herein include an adhesive applicator that has a body with a first end and a second end with a tip that includes one or more outlet openings. The body can define a lumen therethrough and an inlet opening at the first end that is in fluid communication with the lumen and the outlet opening. The tip can include a contact surface adapted to engage with a sole of a shoe sole, the outlet openings sized to dispose a band of adhesive along a peripheral region of a surface of the sole.

Certain embodiments provided herein include a method of manufacturing a shoe. The method can include obtaining a nozzle comprising a body that includes a first end and a second end with a tip that includes one or more outlet openings. The first end of the body can define an inlet opening a lumen therethrough. The method can include positioning the nozzle parallel to, at an angle oblique to, or orthogonal to a desired adhesive path direction. The method can further include dispensing an adhesive to a surface of a sole of a shoe, an upper of a shoe, or both, from the outlet openings while moving the nozzle around a peripheral region of the sole or upper. In some embodiments, the method includes removing undesirable residual adhesive along exterior portions of the shoe using a dry ice blasting process.

BRIEF DESCRIPTION OF THE DRAWINGS

FIG. 3B provides a magnified view of FIG. 3A.

FIGS. 7A-7C are a plan view and side views of a fifth embodiment of an adhesive applicator that includes a guide for positioning the applicator during an adhesive application.

DETAILED DESCRIPTION

Figure 1D:
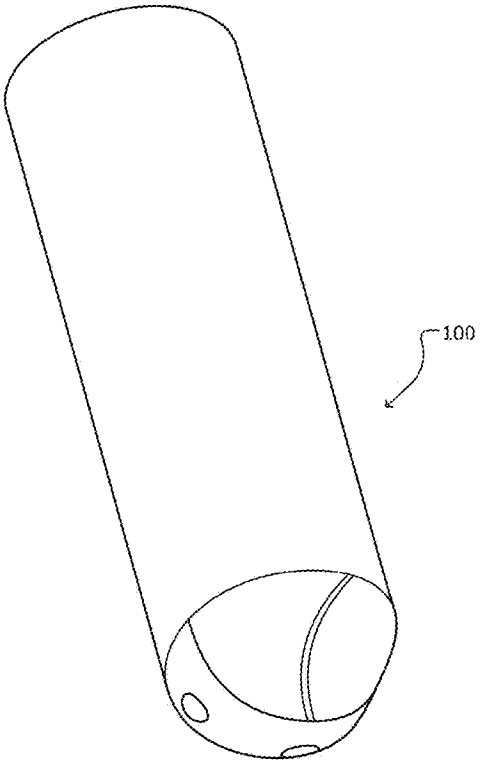
FIGS. 1A-1D are a plan view, a side view and an end view of a first embodiment of an adhesive applicator (or, more specifically, an application head) showing distal tip features and orifices for dispensing an adhesive.

Referring to FIGS. 1A-1D, an adhesive applicator 100 (which can also be referred to as a nozzle, a dispenser, or an application device) can apply an adhesive (not shown) on a workpiece, for example, a sole or an upper of a shoe, during a shoe manufacturing process. During shoe manufacturing, an adhesive can be applied to interior surfaces of a sole (or an upper) of a shoe to bond the sole and the upper together. The adhesive can be applies along a continuous path or, alternatively, at discrete locations, along the interior surfaces of the sole (or upper). Once the adhesive has been sufficiently applied along the interior surfaces of the sole (or upper), the sole and upper are mated together.

The applicator 100, as depicted in FIGS. 1A-1D, includes an elongate body 102 having a first end 104 (e.g., an inlet end) and a second end 106 (e.g., a dispensing end). The depicted body defines a longitudinal axis X1 (FIG. 1A) and a bore 108 (FIG. 1A), or a lumen, therethrough. The first end 104 of the applicator body 102, in some embodiments, can include an inlet opening 110 for receiving an adhesive. The second end of the body can include an applicator tip 112 defining three outlet openings 114 (e.g., apertures) for dispensing the adhesive from the bore 108 of the applicator 100. In various embodiments, the bore 108 can provide an annular adhesive flow path that fluidly connects an inlet opening 114 to the outlet openings 112, such that the adhesive can flow through the body 102 and onto the workpiece. Various embodiments provided herein of the applicator can be used to deliver a viscous fluid adhesive in a hot melt form, or a hot two part form. In some embodiments, the applicator 100 provided herein can dispense adhesive to form an adhesive band along a desired application location(s) on the workpiece.

The first end 104 of the applicator 100 can include the inlet opening 110 adapted for receiving an adhesive such that the adhesive can flow through the bore 108, which provides a flow path in fluid communication with the inlet and outlet openings 110, 114. Some embodiments of the applicator 100 can include a bore 108 sized to allow the adhesive to flow from the first end 104 to the second end 106 of the applicator 100 without creating a capillary effect. In some embodiments, multiple inlet openings 110 are defined at the first end 104 of the applicator 100, for example, to allow two components of a two-part adhesive to mix within the bore 108 of the applicator 100, prior to an application. In some embodiments, each of the multiple inlet openings 110 connect to separate bores 108 within the body 102 of the applicator 100 and outlet openings 114 such that two components of an adhesive (e.g., a two-part adhesive), become exposed to one another after being dispensed from the outlet openings 114.

The second end 106 of the applicator 100 can include various tip designs for dispensing an adhesive on a workpiece, for example, a sole of a shoe. Some embodiments provided herein of an adhesive applicator 100 can include a plow-shaped tip 112 having a convex surface 116 and a concave surface 118 (best shown in FIGS. 1B and 1C). In some embodiments, at least a portion of the convex surface 118 can be a contact surface for engaging the workpiece while the applicator is dispensing adhesive on the workpiece. In various embodiments provided herein, the contact surface is a surface that faces the workpiece and optionally distributes the adhesive on the surface. In some embodiments, the contact surface directly contacts the workpiece and/or indirect contacts the workpiece through a layer of dispensed adhesive. In some embodiments, the contact surface can include one or more outlet openings 114. In other embodiments, the contact surface is located proximate to the outlet openings 114.

Still referring to FIGS. 1A-1D, the applicator tip 112 can optionally include a contact surface (e.g., the convex surface 116) and a non-contact surface (e.g., the concave surface 118). In some embodiments, the contact surface shaped to bias a dispensed adhesive towards a central region of the surface of the sole. The tip can optionally include, in some embodiments, a contact surface for metering a dispensed adhesive along a surface of the sole such that the dispensed adhesive has a width of about 15 millimeters to about 20 millimeters. In some embodiments, the tip includes multiple contact or non-contact surfaces. The non-contact surface generally faces away from the workpiece and does not come into direct or indirect contact with the workpiece, in some embodiments. In use, the contact surface can be placed in contact with the surface of the workpiece while the applicator body is moved across the surface. The contact surface can help regulate a controlled application of adhesive from outlet opening 114 onto the workpiece surface such that a thin film of adhesive forms on the workpiece. The open time of the adhesive can be controlled either by its temperature (as the hot melt adhesive) or by its chemical constituents (a curing adhesive).

The tip can include various shapes for dispensing and metering an adhesive. For example, the tip can, in some embodiments, include a front profile that has a rounded edge, a u-shaped, a v-shaped edge, a beveled edge, or a rectangular-shaped edge. In some embodiments, the tip can include a plow-shaped tip that has a concave surface and a convex surface, in which a portion of the convex surface is the contact surface. In some embodiments, the tip can optionally include one or more beveled edges. In some embodiments, the tip can include a rudder shaped tip configured for steering or directing the adhesive. In some embodiments, the tip can include a duckbill nozzle tip or a v-shaped nozzle tip.

The applicator 100 can include outlet openings configurations of varying sizes, shapes, and locations of outlet openings 114 at the tip 112. In some embodiments, the outlet opening configuration can be adapted for uniform dispensing of the adhesive on the workpiece. In some embodiments, the outlet opening configuration can be adapted for biased dispensing of an adhesive, for example, dispensing the adhesive to flow towards a central region of a sole rather than its periphery region. Some embodiments of the applicator 100 provided herein can include a tip 112 that has one outlet opening 114, or a plurality of outlet openings 114. For example, in some embodiments, the first end 104 of the applicator 100 provided herein can have one, two, three, four, five, six, seven, eight, nine, ten or more than ten outlet openings 114. In some embodiments, the applicator 100 provided herein can include a first end 104 having a slot aperture (not shown). The applicator 100 provided herein can, in some embodiments, can include outlet openings 114 having various suitable cross-sectional shapes including, but is not limited to, a circular, an oval, and an ellipsoid opening. In some embodiments, the applicator 100 provided herein can include outlet openings 114 at a distal surface 124 of the tip, side surfaces 126 of the tip, or both.

Figure 1B:
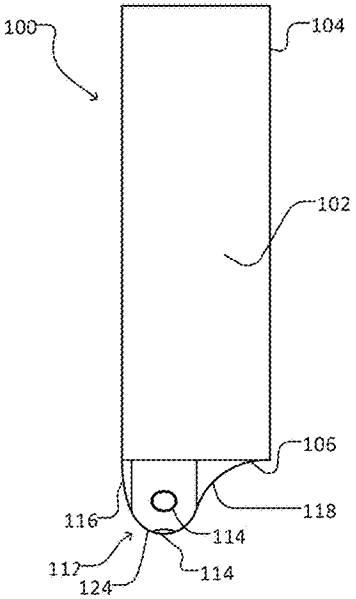
Figure 1A:
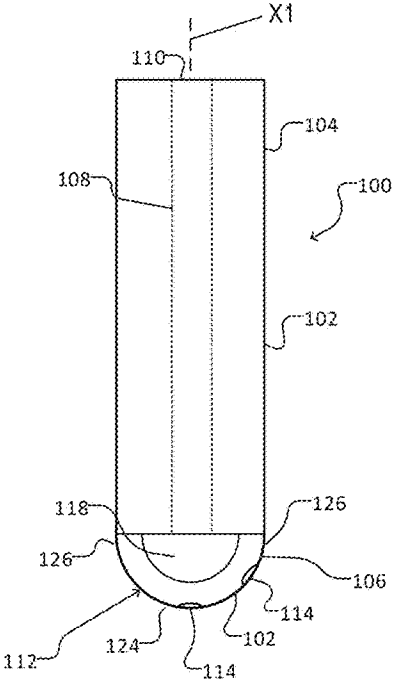
Figure 1C:
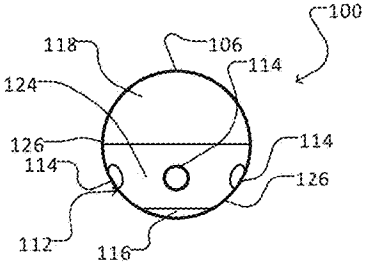

Still referring to FIG. 1C, which is an end view of the applicator body 100 of FIG. 1A, the body 110200 includes a distal surface 124 defined with the three outlet openings 114. The depicted distal surface 124 is defined by a plane oriented at an angle orthogonal or oblique to the longitudinal axis X1 of the body 102. The distal surface 124 can be located between the contact surface (e.g., the convex surface 116) and the non-contact surface (e.g., the concave surface 118), as shown in FIG. 1C.

Adhesive applicators 100 provided herein are scalable to a range of sizes. In some embodiments, for example, the applicator 100 can have a length "X" (as shown in FIG. 1A) ranging from about 1 inch to about 10 inches, including all values and ranges therebetween. The width dimension "Y" (e.g., diameter, as shown in FIG. 1A) of the body 102 of the applicator 100 can range, in some embodiments, from about 0.5 inches to about 5 inches, including all values and ranges therebetween.

In some embodiments, the size of the inlet and outlet openings 110, 114 can range from about 0.6 millimeters (or about 0.025 inches) to about 2.5 inches (or about 0.100 inches), including all values and ranges therebetween. In various embodiments, the outlet openings can be sized to dispose a band of adhesive along a peripheral region of a surface of the sole. In some embodiments, each outlet can have a diameter ranging from about 0.2 millimeters (or about 0.008 inches) to about 2.0 millimeters (or about 0.079 inches).

Figure 2B:
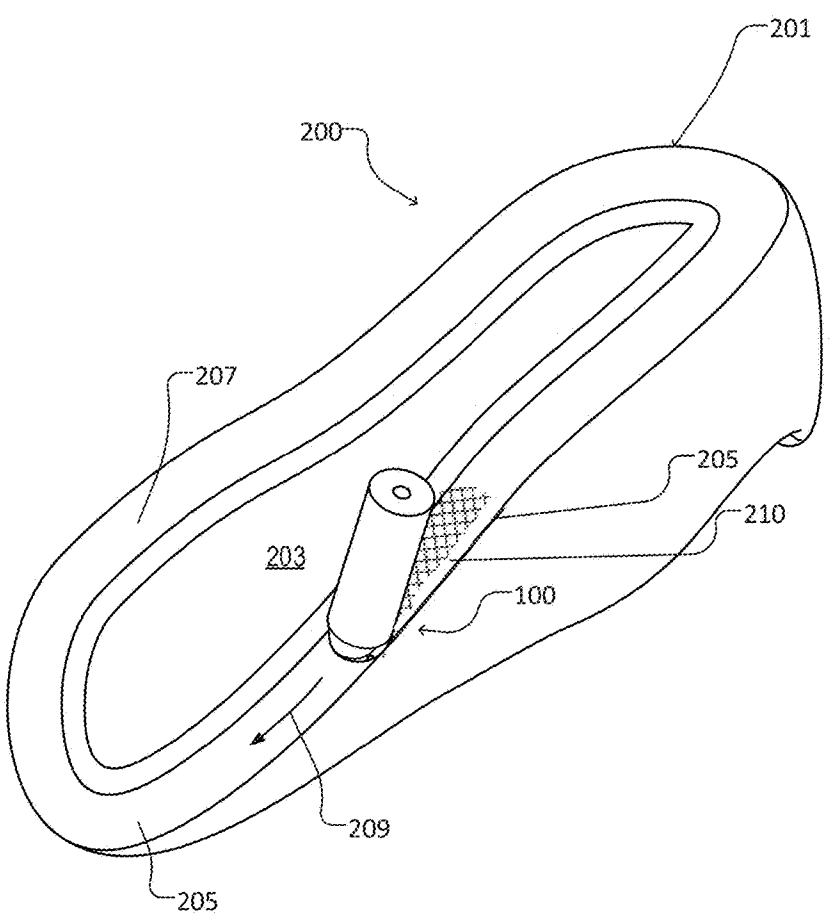
FIGS. 2A and 2B are a plan view and a perspective view, respectively, of a shoe upper showing the adhesive applicator of FIGS. 1A-1C with respect to an application zone and a periphery of the upper.
Figure 2A:
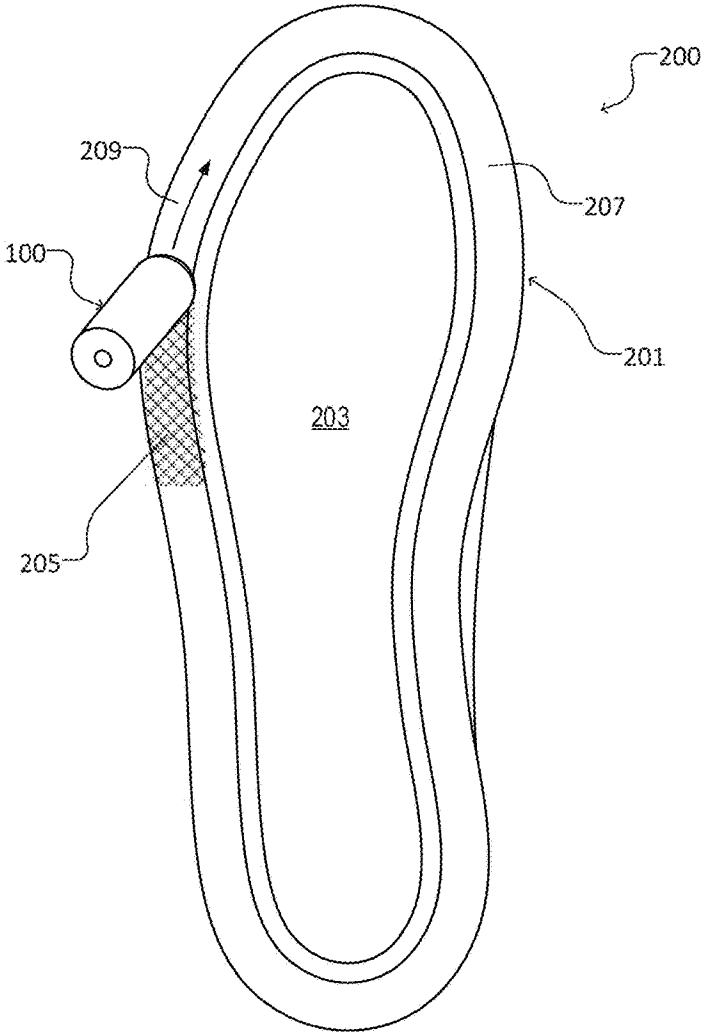

Referring to FIGS. 2A and 2B, a bottom view of an upper/last assembly 200 shows exposed inner surfaces of the upper 201 bonded to and supported by a last 203. A mode of application of adhesive includes using the adhesive applicator 100 of FIGS. 1A-1C to dispense an adhesive 205 in one or more desired locations on the upper 201. In various embodiments, the applicator 100 can apply the adhesive 205 in a controlled manner to form a continuous band of adhesive 205 having a desired width and thickness. Forming a band of adhesive 205 with a consistent width and thickness allows for a correct amount of adhesive 205 to be disposed on the upper 201 (or sole) such that a mechanically stable bond is obtained without the adhesive soiling an exterior surface of the upper 201 or a sole (not shown).

The depicted adhesive applicator 100 can apply the adhesive 205 to a shoe upper 201 along the exposed inner surfaces 207 of the upper 201, which is supported by the last 203 during shoe manufacturing. The upper 201 can be placed on the last 203 using conventional shoe manufacturing techniques. In an adhesive application, in some embodiments, the contact surface (e.g., the convex surface 116 of applicator 100 of FIGS. 1A-1C) and/or the distal surface 124 of the tip 112 contacts a surface 207 of the upper 201. The applicator 100 can be moved in a clockwise direction, as shown by directional path 209 (or, alternatively, a counterclockwise direction) when applying an adhesive coating on the upper 201. In some embodiments, the applicator body 100 can be positioned at an angle $\alpha$ (as will be discussed in reference to FIG. 3B) to a tangential direction of the applicator 100, or the path 209 of the adhesive pattern, such that as the adhesive flows from outlet openings (e.g., outlet openings 114 as shown in FIGS. 1A-1C) onto the upper 201. Furthermore, the applicator body 100 can be positioned at an oblique angle relative to the surface plane of the surface 207 of the upper 201. Alternatively, in some embodiments, the applicator body 100 can be positioned orthogonal to the surface 207 of the upper 201. In some embodiments, the dispensed adhesive can be directed by the applicator tip profile to towards a central portions of the upper/last assembly (e.g., towards the exposed last 203) to reduce or eliminate the risk of excess adhesive spilling from the upper and/or become forced from the shoe as the shoe is assembled by contacting a sole (not shown) with the adhesive 205 on the upper 201. In some embodiments, the applicator 100 can be applied to a sole of a shoe in the same, or a similar manner, as described above.

Figure 3B:
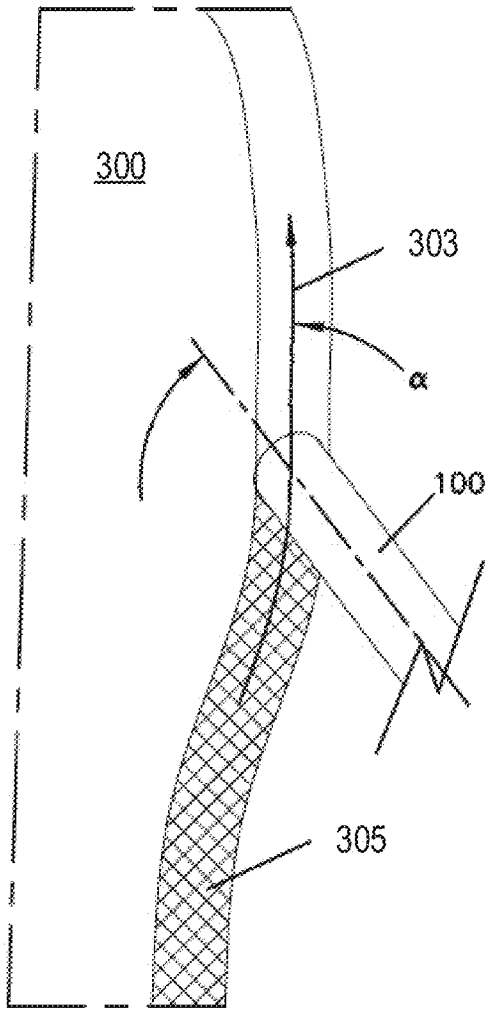
FIGS. 3A and 3B are plan views of a shoe sole showing the adhesive applicator of FIGS. 1A-1C with respect to an application zone and a periphery of the sole.
Figure 3A:
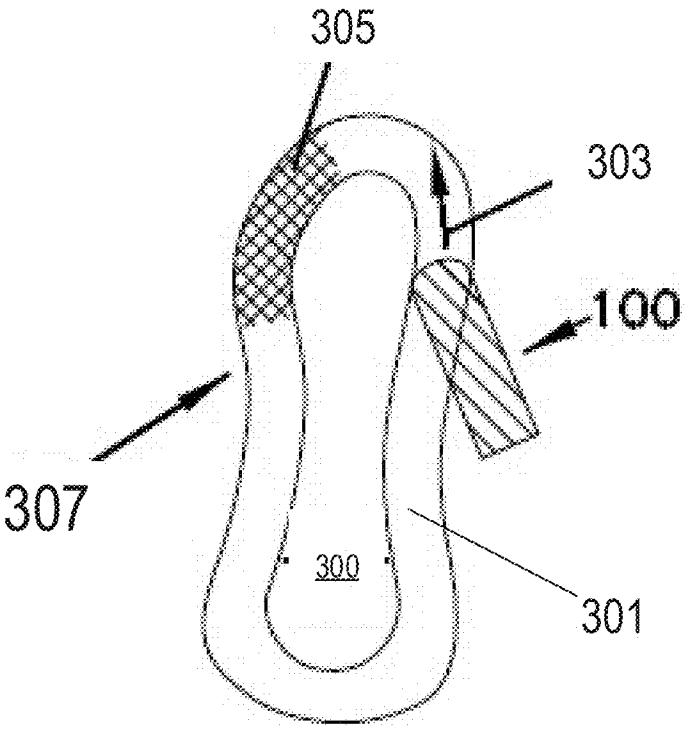

Referring to FIGS. 3A and 3B, a shoe sole 300 is in contact with the applicator body 100 of FIGS. 1A-1C. In particular, the contact surface (e.g., the convex surface 116) of the applicator tip 112 (see FIGS. 1A-1C) is in contact with the sole 300. The applicator (e.g., the applicator 100) can be moved along a peripheral region 301 of the sole 300 in a path direction 303, for example, in a counterclockwise direction, around the sole 300 such that a controlled coating of the adhesive 305 is place along the perimeter of the sole 300. In FIG. 3A, the combination of sole and adhesive coating 307 is shown.

Still referring to FIGS. 3A and 3B, the applicator body can be held at an angle α relative to a tangential direction of the applicator, or an angle α relative to the adhesive application path. In some embodiments, the applicator body 100 can be positioned at an angle α to the desired direction path 303 to ensure that the adhesive 305, when applied to the perimeter of the sole 300, forces the adhesive to an interior region of the sole 300. The adhesive 305 is then controlled such that the adhesive 305 does not flow to the periphery or over the periphery of the sole 300 either during bonding or after bonding of the sole 300 to an upper (e.g., the upper 201 of FIG. 2) during a shoe assembly process.

Figure 4A:
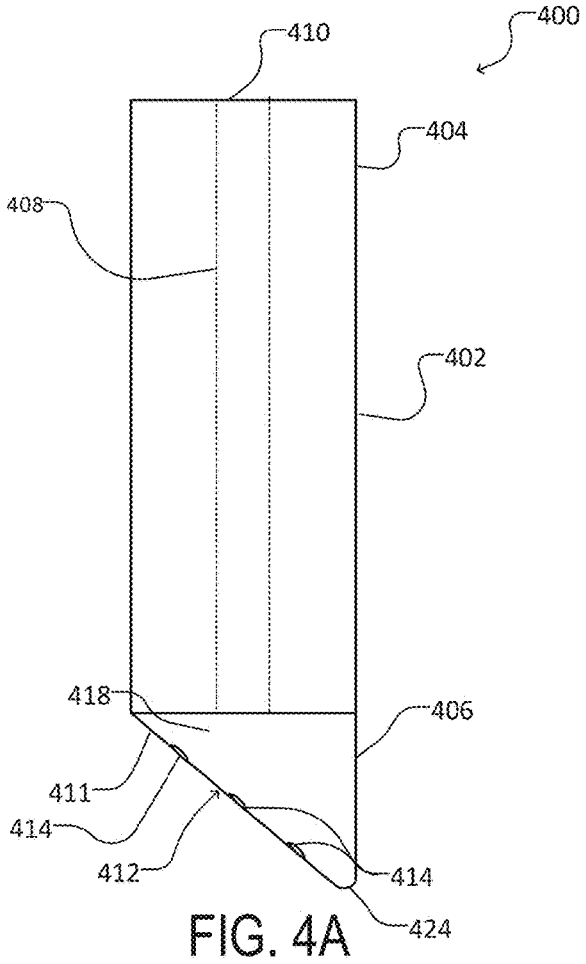
FIGS. 4A-4C are a plan view, a side view and an end view of a second embodiment of an adhesive applicator.
Figure 4B:
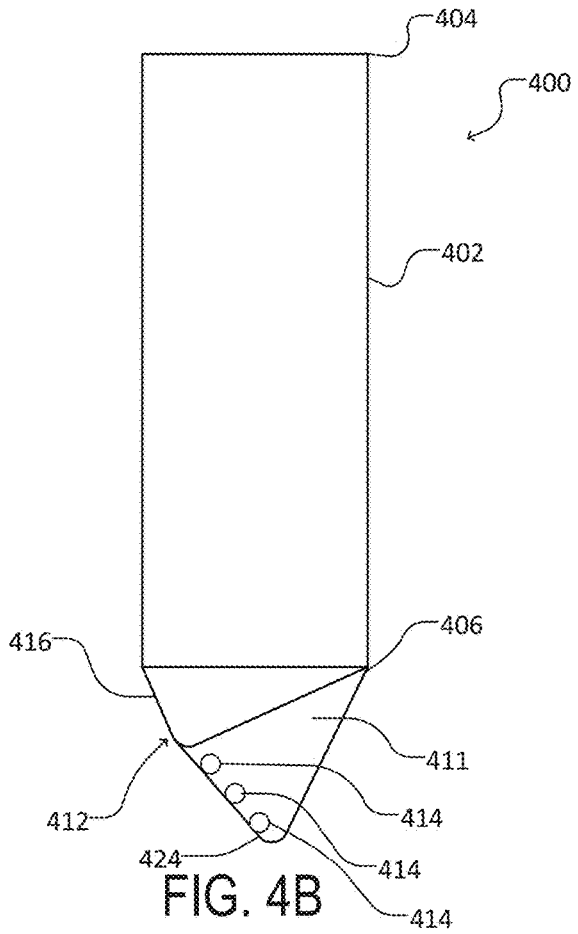
Figure 4C:
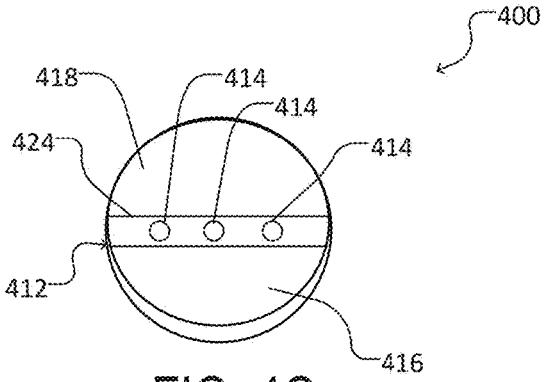

Referring to FIGS. 4A-4C, a second embodiment of an adhesive applicator 400 includes an elongate body 402 having a first end 404 (e.g., an inlet end) and a second end 406 (e.g., a dispensing end), and defining a bore 408 therethrough. The depicted applicator body 402 has an inlet opening 410 for receiving an adhesive at the first end 404 and a beveled edged tip 412 at the second end 406 of the body 402. The tip 412 can include, in some embodiments, two beveled side edges 416, 418 and three outlet openings 414 a distal surface 424 of the tip 410 for dispensing the adhesive contained within the bore 408 of the applicator 400.

Referring to FIG. 4A, a top (plan) view of the applicator 400 shows a first beveled surface 411. In some embodiments, the first beveled surface 411 can bias a dispensed adhesive laterally along a surface of a workpiece, for example, towards a central region of a sole.

Referring to FIGS. 4B and 4C, which provides a side view of the applicator 400, the tip 412 of the applicator 400 can include a second beveled surface 416 and a third beveled surface 418. In some embodiments, the second beveled surface 416 can be a contact surface facing toward the workpiece, and either directly or indirectly contacting a surface of the workpiece. In some embodiments, the second beveled 416 surface can flatten or distribute a dispensed adhesive on a surface of a workpiece, e.g., a sole. The second beveled surface 416 can, in some embodiments, shape a dispensed adhesive into a form having a uniform width and height on the surface of the workpiece. The third beveled surface 418 generally faces away from the workpiece, in various embodiments. Many of the embodiment variations discussed herein may be applied to the embodiment shown in FIGS. 4A-4C.

Figure 5A:
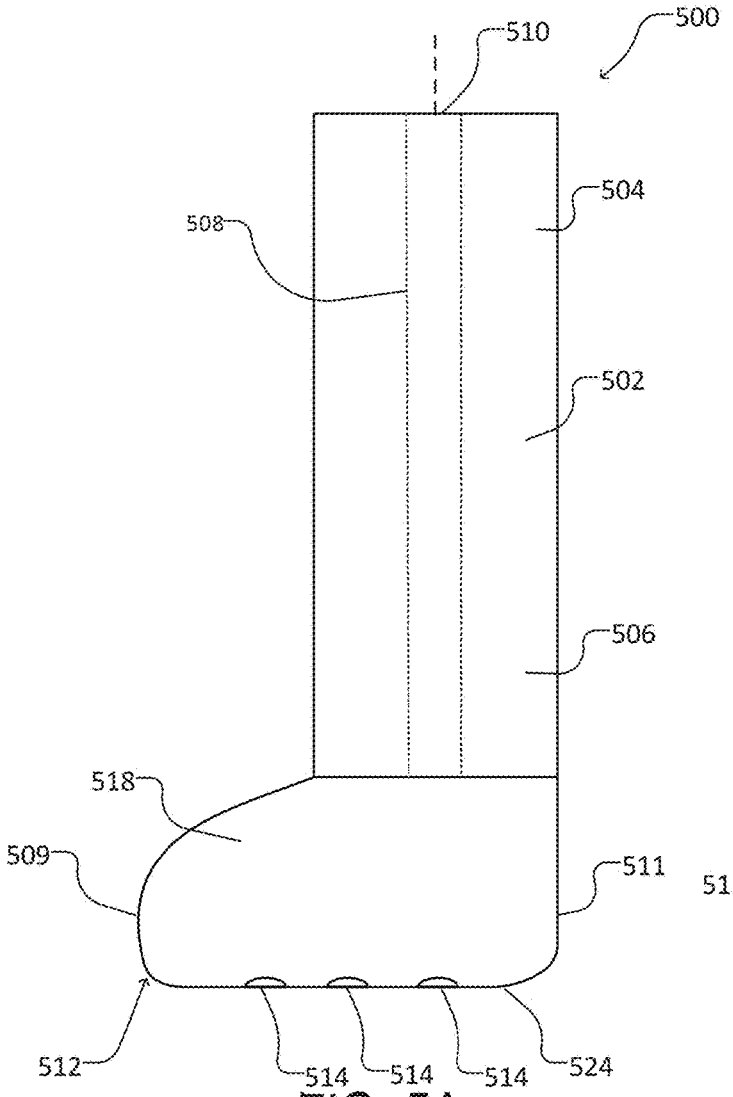
FIGS. 5A-5C are a plan view, a side view and an end view of a third embodiment of an adhesive applicator.
Figure 5B:
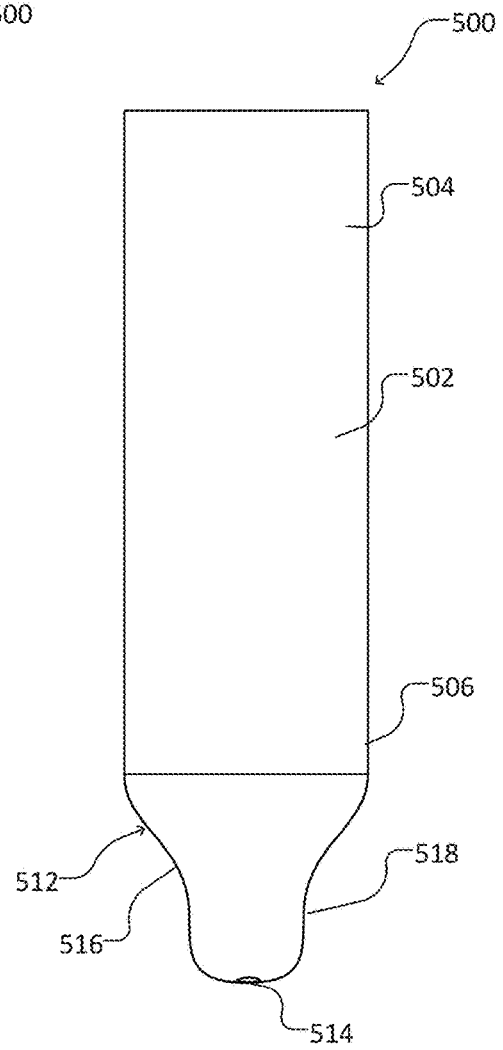
Figure 5C:
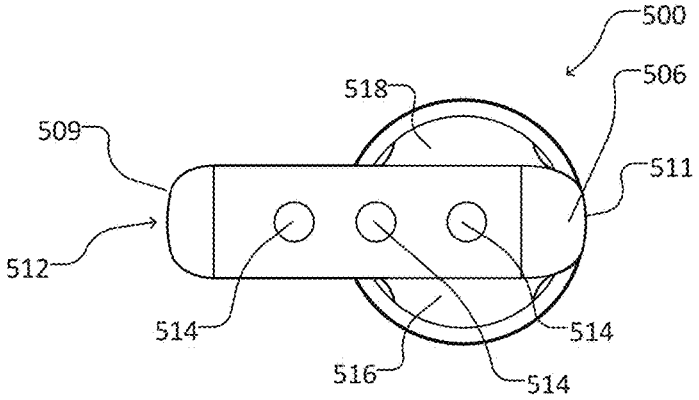

Referring to FIGS. 5A-5C, a third embodiment of an adhesive applicator 500 includes an elongate body 502 having a first end 504 (e.g., an inlet end) and a second end 506 (e.g., a dispensing end), and defining a bore 508 therethrough. The depicted applicator body 502 has an inlet opening 510 for receiving an adhesive at the first end 504 and a tip 514 at the second end 506 of the body 502. As shown, the depicted tip 512 can include a non-cylindrical shaped tip 512 and three outlet openings 514 for dispensing the adhesive from the bore 508 of the applicator 500 along a distal surface of the tip 510.

Referring in particular to FIG. 5A, a top (plan) view of the applicator 500 shows rudder-shaped tip 512 having a first side 509 with a straight or substantially straight edge and a second side 511 with a curved edge. In some embodiments, the curved edge of the second side 511 can allow for smooth maneuverability around side edges of an upwardly protruding portion of a sole or an upper, for example, a raised peripheral edge of a sole (not shown).

Referring back to FIGS. 5B and 5C, which provides a side view of the applicator 500, the tip 512 of the applicator 500 can include two concave surfaces: a first and second concave surface 516, 518. In some embodiments, the first concave surface 516 of the tip 512 can be a contact surface facing towards a workpiece and directly or indirectly contacting a surface of the workpiece. In some embodiments, the first concave surface 516 can flatten or distribute a dispensed adhesive on a surface of a workpiece, e.g., a sole. The first surface concave 516 can, in some embodiments, shape a dispensed adhesive into a form having a uniform width and height on the exterior surface of the workpiece. The second concave surface 518 can face away from the workpiece in various embodiments. Many of the features discussed herein with other embodiments can also be applied to the embodiment shown in FIGS. 5A-5C.

Figure 6A:
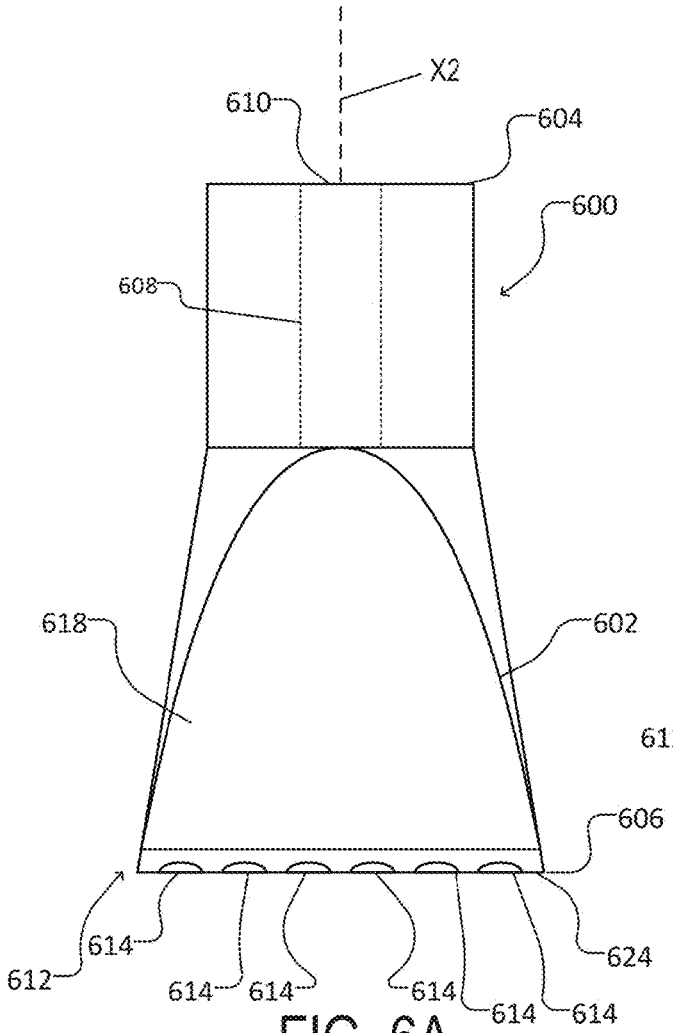
FIGS. 6A-6C are a plan view, a side view and an end view of a fourth embodiment of an adhesive applicator.
Figure 6B:
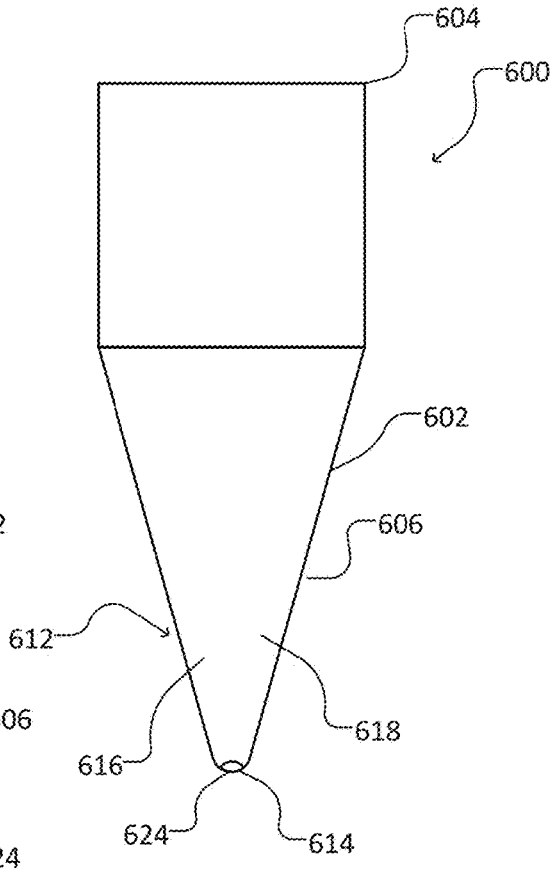
Figure 6C:
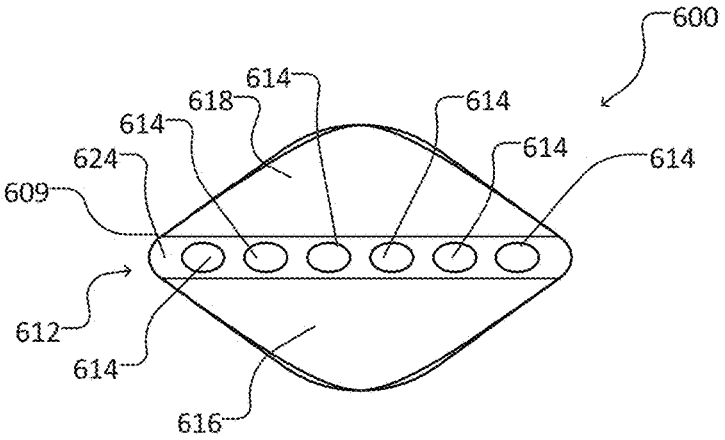

Referring to FIGS. 6A-6C, a fourth embodiment of an adhesive applicator 600 includes an elongate body 602 having a first end 604 (e.g., an inlet end) and a second end 606 (e.g., a dispensing end). The depicted body 602 defines a longitudinal axis X2 and a bore 608 therethrough. The depicted applicator body 602 has an inlet opening 610 for receiving an adhesive at the first end 604 and a tip 610 at the second end of the body 602. As shown, the depicted tip 612 can include a non-cylindrical shaped tip 612 and three outlet openings 614 for dispensing the adhesive from the bore 608 of the applicator 600 along a distal surface 624 of the tip 612.

Referring in particular to FIG. 6A, a top (plan) view of the applicator 600 shows a duckbilled shaped tip 612 that gradually flares and flattens along the longitudinal axis X2 in a direction towards a distal edge 624 of the tip 612. In some embodiments, the flared distal edge 624 of the tip 612 can spread the adhesive on a workpiece to form a continuous band of adhesive having a desired width and thickness.

Referring back to FIGS. 6B and 6C, which provides a side view of the applicator 600, the tip 612 of the applicator 600 can include two symmetrically sloped surfaces: a first and second sloped surface 616, 618. In some embodiments, the first sloped surface 616 of the tip can be a contact surface facing towards the workpiece and directly contacting a surface of the workpiece. In some embodiments, the first sloped surface 616 can flatten or distribute a dispensed adhesive on a surface of a workpiece, e.g., a sole. The first sloped surface 616 can, in some embodiments, shape a dispensed adhesive into a form having a uniform width and height on the exterior surface of the workpiece. The second sloped surface 618 can face away from the workpiece in various embodiments. Many of the features discussed herein with other embodiments can also be applied to the embodiment shown in FIGS. 6A-6C.

Referring to FIGS. 7A-7C, a fifth embodiment of an adhesive applicator 700 includes an elongate body 702 having a first end 704 (e.g., an inlet end) and a second end 706 (e.g., a dispensing end). The depicted body 702 defines a longitudinal axis X3 and a bore 708 therethrough. The depicted applicator body 702 has an inlet opening for receiving an adhesive at the first end 704 and a tip 712 at the second end of the body. As shown, the depicted tip can include a non-cylindrical shaped tip and three outlet openings 714 for dispensing the adhesive from the bore 708 of the applicator 700 along a distal surface of the tip 712. In some embodiments, as shown, the applicator 700 includes a guide 730 for positioning the applicator a predetermined distance from a periphery of a sole or upper.

Referring to FIG. 7A, a top (plan) view of the applicator 700 shows a guide 730 with an elongate body extending in the same direction as the longitudinal axis X3 and an L-shaped lateral extension proximate to the applicator tip. In various embodiments, the L-shaped lateral extension can position the applicator body a pre-determined distance from a peripheral edge of a sole or upper. In some embodiments, the applicator can include a guide 730 shaped and sized to align the nozzle body along a peripheral region of a sole. In some embodiments, the guide 730 can be configured to align the nozzle body from about 0.5 mm to about 20 mm from a peripheral edge of a sole. In some embodiments, the guide 730 can be configured for releasable attachment to the nozzle body.

In some embodiments, the applicator tip 712 can include a generally blunt tip 712 with rounded corner edges. Some embodiments of the blunt tip 712 include rounded corner edges to allow for smooth maneuverability around side edges of an upwardly protruding portion (or portions) of a sole or an upper, for example, a raised peripheral edge of a sole (not shown).

Referring to FIGS. 7B and 7C, which provide side views of the applicator 700, the tip 712 of the applicator 700 can include a v-shaped side profile having two symmetrically sloped surfaces: first and second sloped surfaces 716, 718. In some embodiments, both the first and second sloped surfaces 716, 718 are non-contacting surfaces because the applicator is positioned generally orthogonal to a shoe surface. In some embodiments, however, the first sloped surface 716 of the tip 712 can be a contact surface facing towards the workpiece and directly contacting a surface of the workpiece. In some embodiments, the first sloped surface 716 can flatten or distribute a dispensed adhesive on a surface of a workpiece, e.g., a sole. The first sloped surface 716 can, in some embodiments, shape a dispensed adhesive into a form having a uniform width and height on the exterior surface of the workpiece. The second sloped surface 718 generally faces away from the workpiece in various embodiments. Many of the features discussed herein with other embodiments can also be applied to the embodiment shown in FIGS. 7A-7C.

Figure 8B:
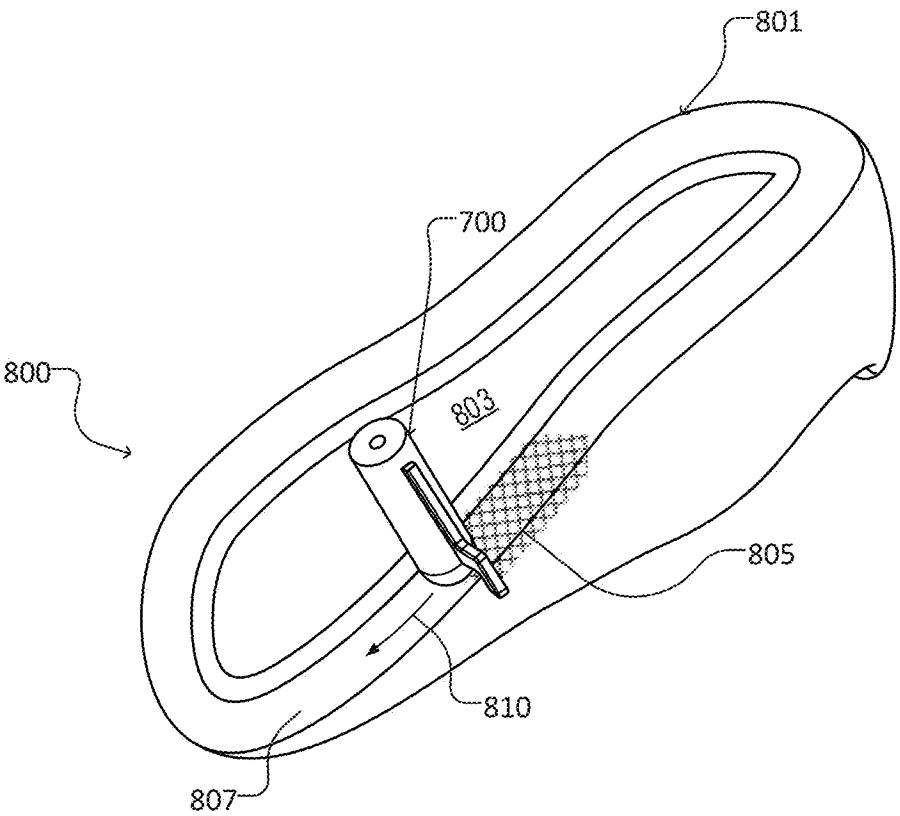
FIGS. 8A and 8B are a plan view and a perspective view, respectively, of a shoe upper showing the adhesive applicator of FIGS. 7A-7C dispensing adhesive onto the upper.
Figure 8A:
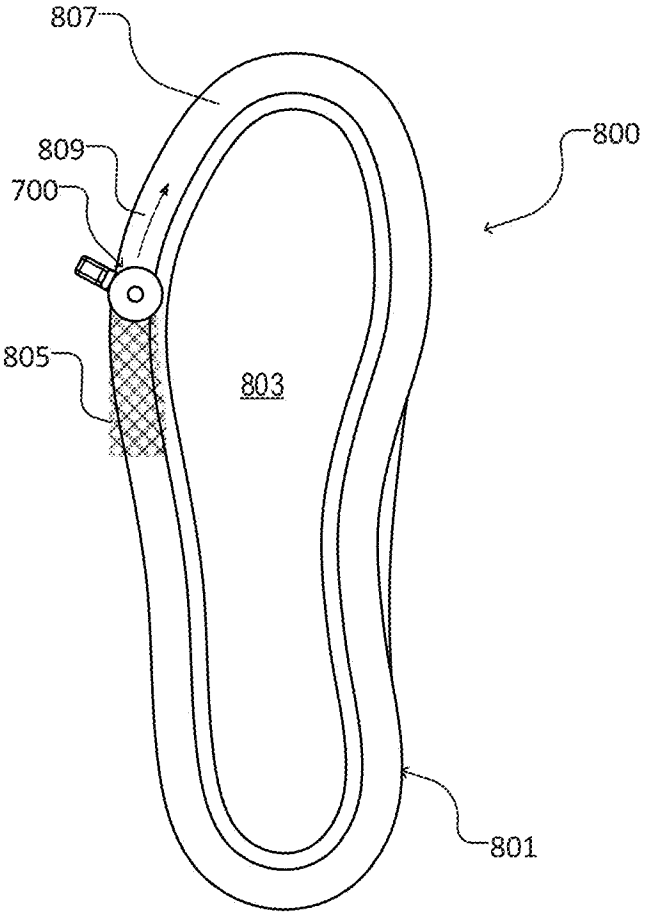

Referring to FIGS. 8A and 8B, the applicator 700 of FIGS. 7A-7C can be used to apply an adhesive 805 along an upper/last assembly 800 on the exposed inner surfaces 807 of the upper 801. A mode of application of adhesive includes using the adhesive applicator 100 of FIGS. 1A-1C to dispense an adhesive 805 in one or more desired locations on the upper 201. In various embodiments, the applicator 700 can apply the adhesive 805 in a controlled manner to form a continuous band of adhesive 805 having a desired width and thickness. Forming a band of adhesive 805 with a consistent width and thickness allows for a correct amount of adhesive 805 to be disposed on the upper 801 (or sole) such that a mechanically stable bond is obtained without the adhesive soiling an exterior surface of the upper 801 or a sole (not shown).

The depicted adhesive applicator 700 can apply the adhesive 805 to a shoe upper 801 along the exposed inner surfaces 807 of the upper 801, which is supported by the last 803 during shoe manufacturing. The upper 801 can be placed on the last 803 using conventional shoe manufacturing techniques. In an adhesive application, in some embodiments, the applicator can be oriented orthogonal or about orthogonal to the inner surface 807 of the upper 801 such that the distal surface of the tip of the applicator 700 contacts the inner surface 807 of the upper 801. The applicator 700 can be moved in a clockwise direction, as shown by directional path 809 (or, alternatively, a counter-clockwise direction) when applying an adhesive coating on the upper 801. In some embodiments, the applicator 700 can be applied to a sole of a shoe in the same, or a similar manner, as described above.

Some embodiments provided herein includes a shoe sole having an outer surface, an inner surface, and a lateral wall therebetween. In some embodiments, the inner surface can have a continuous application zone proximate to a periphery of the inner surface. The continuous application zone may optionally have a width ranging from about 15 to about 20 millimeters. The continuous application zone, in some embodiments, can include an adhesive in an amount of about 0.5 grams to about 5 grams per shoe along the continuous application zone.

In some embodiments, the inner surface of the shoe sole can include a peripheral zone (for example, peripheral zone 210 in FIG. 2B) between the application zone and the periphery of the inner surface, in which the peripheral zone is an area that is free or substantially free of an adhesive. In some embodiments, the peripheral zone is free or substantially free of the adhesive prior to the shoe sole being coupled to a shoe upper. The periphery zone, in certain embodiments, can have a continuous area adjacent to the periphery of the shoe sole that is free of the adhesive after the shoe sole has been coupled to a shoe upper. A suitable periphery zone can be sized and shaped to reduce or prevent the adhesive from squeezing out to the periphery of the shoe sole when the shoe sole is coupled to a shoe upper. In some embodiments, the periphery zone can have a width of about 15 to about 20 millimeters.

In some embodiments, the adhesive applied on the shoe sole can have a width of about 15 millimeters to about 20 millimeters. In some embodiments, the adhesive has a thickness of about 0.05 millimeters to about 0.5 millimeters. The adhesive can be a hot melt adhesive, in some embodiments. In particular, in some embodiments, the hot melt adhesive can be a two-part adhesive that includes a reactive component and a nonreactive component.

Certain embodiments provided herein include a method of manufacturing a shoe. The method can include obtaining a nozzle comprising a body that includes a first end and a second end with a tip that includes one or more outlet openings. The first end of the body can define an inlet opening a lumen therethrough. The method can include positioning the nozzle parallel to, at an angle oblique to, or orthogonal to a desired adhesive path direction. The method can further include dispensing an adhesive to a surface of a sole of a shoe, an upper of a shoe, or both, from the outlet openings while moving the nozzle around a peripheral region of the sole or upper.

The method of manufacturing a shoe may also include processes for removing adhesive flashing (undesirable residual adhesive) that may form when a sole and an upper are joined together for bonding. In some embodiments, the residues can be manually scraped, scoured, or sanded with hand held tools or automated equipment. In some embodiments, the method includes removing undesirable residual adhesive along exterior portions of the shoe using a dry ice blasting process. Dry ice blasting includes, in various embodiments, the application of a solid form of carbon dioxide in an accelerated, pressurized air stream that can be directed at a surface of a shoe for cleaning. Dry ice blasting can clean without leaving chemical residues after the dry ice sublimates at room temperature.

A number of embodiments of the invention have been described. Nevertheless, it will be understood that various modifications may be made without departing from the scope of the invention. Accordingly, other embodiments are within the scope of the following claims.

We claim:

1. An adhesive applicator, comprising:

a body that includes a first end and a second end with a tip that includes one or more outlet openings, the body defining a lumen therethrough and an inlet opening at the first end that is in fluid communication with the lumen and the one or more outlet openings, the tip including a contact surface adapted to engage with a sole of a shoe, the one or more outlet openings sized to dispose a band of adhesive along a peripheral region of a surface of the sole, wherein the tip is a plow-shaped tip comprising a concave surface and a convex surface, wherein a portion of the convex surface is the contact surface, and wherein the contact surface includes the one or more outlet openings or is proximate to the one or more outlet openings.

2. The adhesive applicator of claim 1, wherein the body defines from two to ten outlet openings.

3. The adhesive applicator of claim 1, wherein each outlet has a diameter ranging from about 0.2 millimeters to about 2.0 millimeters.

4. The adhesive applicator of claim 1, wherein the tip includes a contact surface adapted for biasing a dispensed adhesive towards a central region of the surface of the sole.

5. The adhesive applicator of claim 1, wherein the tip includes a contact surface adapted metering a dispensed adhesive along a surface of the sole such that the dispensed adhesive has a width of about 15 millimeters to about 20 millimeters.

6. The adhesive applicator of claim 5, wherein the tip has a front profile comprising a rounded edge, a u-shaped, a v-shaped edge, a beveled edge, or a rectangular-shaped edge.

7. The adhesive applicator of claim 1, further comprising a guide shaped and sized to align the nozzle body along a peripheral region of the sole.

8. The adhesive applicator of claim 7, the guide configured to align the nozzle body from about 0.5 mm to about 20 mm from a peripheral edge of the sole.

9. The adhesive applicator of claim 7, the guide is configured for releasable attachment to the nozzle body.

10. The adhesive applicator of claim 1, wherein the body comprises a nozzle.

11. The adhesive applicator of claim 1, wherein the body defines three outlet openings.

12. The adhesive applicator of claim 1, wherein the body defines multiple inlet openings.

13. The adhesive applicator of claim 12, wherein each of the multiple inlet openings fluidly connect to separate bores defined within the body.

14. The adhesive applicator of claim 1, wherein the body is configured for mixing two components of an adhesive to mix within the applicator.

15. The adhesive applicator of claim 1, wherein tip includes a contact surface and a non-contact surface.

16. The adhesive applicator of claim 15, wherein the contact surface is a convex surface.

17. The adhesive applicator of claim 15, wherein the non-contact surface is a concave surface.

18. The adhesive applicator of claim 1, wherein the tip defines one or more beveled edges.

19. A method of manufacturing a shoe, the method comprising:

Obtaining the adhesive applicator of claim 1;

positioning the adhesive applicator parallel to, at an angle oblique to, or orthogonal to a desired adhesive path direction; and dispensing an adhesive to a surface of a sole of a shoe, an upper of a shoe, or both, from the one or more outlet openings while moving the adhesive applicator around a peripheral region of the sole or upper.

20. The method of claim 19, further comprising removing undesirable residual adhesive along exterior portions of the shoe using a dry ice blasting process.

* * * * *